US009486845B2

(12) United States Patent
Yamane et al.

(10) Patent No.: US 9,486,845 B2
(45) Date of Patent: Nov. 8, 2016

(54) INNER SURFACE REGULATION TOOL, PLUG, MANDREL, HOT ROLLING MILL, PRESS PIERCING MACHINE, AND DRAWING MACHINE

(71) Applicant: NIPPON STEEL & SUMITOMO METAL CORPORATION, Chiyoda-ku, Tokyo (JP)

(72) Inventors: Kouji Yamane, Tokyo (JP); Kazuhiro Shimoda, Tokyo (JP); Tomio Yamakawa, Tokyo (JP); Yuji Inoue, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/410,162

(22) PCT Filed: Aug. 22, 2013

(86) PCT No.: PCT/JP2013/072396

§ 371 (c)(1),
(2) Date: Dec. 22, 2014

(87) PCT Pub. No.: WO2014/030692

PCT Pub. Date: Feb. 27, 2014

(65) Prior Publication Data

US 2015/0314346 A1 Nov. 5, 2015

(30) Foreign Application Priority Data

Aug. 24, 2012 (JP) ..... 2012-185032

(51) Int. Cl.
*B21C 25/04* (2006.01)
*B21J 5/10* (2006.01)
(Continued)

(52) U.S. Cl.
CPC ..... *B21B 25/00* (2013.01); *B21B 17/02* (2013.01); *B21B 25/06* (2013.01); *B21C 1/16* (2013.01); *B21C 3/16* (2013.01); *B21C 25/04* (2013.01); *B21J 5/10* (2013.01); *B21B 19/04* (2013.01)

(58) Field of Classification Search
CPC ..... B21B 17/02; B21B 19/04; B21B 25/00; B21C 1/16; B21C 3/16; B21C 25/04; B21J 5/10
See application file for complete search history.

(56) References Cited

U.S. PATENT DOCUMENTS 3,581,538 A 6/1971 Asari et al.
4,022,043 A 5/1977 Meurer et al.
8,069,918 B2 * 12/2011 Zimmerman ..... E21B 33/129 166/216

FOREIGN PATENT DOCUMENTS

CN 1929933 3/2007
CN 201357497 12/2009
(Continued)

OTHER PUBLICATIONS

International Search Report dated Sep. 17, 2013 issued in corresponding PCT Application No. PCT/JP2013/072396 [with English Translation].
(Continued)

*Primary Examiner* — Teresa M Ekiert
(74) *Attorney, Agent, or Firm* — Birch, Stewart, Kolasch & Birch, LLP

(57) ABSTRACT

An inner surface regulation tool includes a mandrel, a plug which is detachably connected to the mandrel, and a connection member which connects the plug and the mandrel by a magnetic force. One of the plug and the mandrel includes a column-shaped portion which extends in an axial direction of the one, and the other of the plug and the mandrel includes a joining hole which extends in an axial direction of the other and into which the column-shaped portion is inserted. In addition, the connection member is a permanent magnet which is attached to at least one of the column-shaped portion and the joining hole.

9 Claims, 11 Drawing Sheets

(51) Int. Cl.

| | |
|---|---|
| ***B21B 19/04*** | (2006.01) |
| ***B21B 25/00*** | (2006.01) |
| ***B21B 17/02*** | (2006.01) |
| ***B21C 1/16*** | (2006.01) |
| ***B21B 25/06*** | (2006.01) |
| ***B21C 3/16*** | (2006.01) |

(56) References Cited

FOREIGN PATENT DOCUMENTS

| | | |
|---|---|---|
| CN | 201417132 | 3/2010 |
| DE | 2347385 | 3/1975 |
| JP | 5970411 | 4/1984 |
| JP | 61-177702 | 11/1986 |
| JP | 2008-229648 | 10/2008 |
| JP | 2009-125785 | 6/2009 |
| SU | 740318 | 6/1980 |
| SU | 1395398 | 5/1988 |

OTHER PUBLICATIONS

Office Action dated Aug. 3, 2015 issued in corresponding CN Application No. 201380038809.7 [with English Translation].
Search Report dated Feb. 29, 2016 issued in corresponding European Application No. 13830546.1.
Dffice Action dated Apr. 29, 2016 issued in related Russian Application No. 2015105761 [with English Translation].

* cited by examiner

INNER SURFACE REGULATION TOOL, PLUG, MANDREL, HOT ROLLING MILL, PRESS PIERCING MACHINE, AND DRAWING MACHINE

TECHNICAL FIELD OF THE INVENTION

This application is a national stage application of International Application No. PCT/JP2013/072396, filed Aug. 22, 2013, which claims priority to Japanese Patent Application No. 2012-185032, filed on Aug. 24, 2012, each of which is incorporated by reference in its entirety.

The present invention relates to an inner surface regulation tool, a plug, a mandrel, a hot rolling mill, a press piercing machine, and a drawing machine.

RELATED ART

A piercing machine and an elongator are widely used as a hot rolling mill for making a seamless metal pipe. The piercing machine includes a pair of inclined rolls and a plug. The plug is disposed on a pass line between the pair of inclined rolls. In the piercing machine, a round billet is pushed into the plug while rotating in the circumferential direction of the round billet, the round billet is piercing-rolled, and thus, a hollow pipe stock (hollow shell) is formed. The elongator is disposed downstream of the piercing machine if necessary. Similar to the piercing machine, the elongator includes a pair of inclined rolls and a plug. The elongator drawing-rolls the hollow pipe stock, and thus, the diameter of the hollow pipe stock is increased and the thickness thereof is thinned.

The plugs included in the piercing machine and the elongator are supported at a predetermined position by a mandrel (mandrel bar). The mandrel extends onto a pass line, and the rear end of the mandrel is fixed by a fixing device such as a thrust block or a stripper block during hot rolling (during piercing-rolling by the piercing machine and during drawing-rolling by the elongator).

The rear end of the plug is connected to the tip of the mandrel. In general, the rear end of the plug has a female screw, and the tip of the mandrel has a male screw. In addition, the tip of the mandrel is screwed into the rear end of the plug, and thus, the plug and the mandrel are connected to each other. Hereinafter, in this way, this is referred to as an inner surface regulation tool in which the plug and the mandrel are integrally connected to each other. That is, the inner surface regulation tool regulates the inner surface shape of the round billet (that is, hollow pipe stock).

In order to hot-roll the round billet and the hollow pipe stock having a high temperature, the plug obtains a high temperature and a high contact pressure from the round billet and the hollow pipe stock. Accordingly, the surface of the plug becomes worn or seized. If piercing-rolling is performed a plurality of times, a portion of the plug may be eroded. If the eroded plug is used for the piercing-rolling, scratches are easily formed on the inner surface of the hot-rolled round billet or hollow pipe stock. Accordingly, the eroded plug is exchanged with a new plug.

When the plug is exchanged, the plug screwed into the mandrel is rotated and extracted from the mandrel, and the new plug is screwed into the mandrel and connected to the mandrel. At this time, if the plug and the mandrel are not disposed to be coaxial with each other and are rotated, a failure in engagement between threads of the male screw and the female screw occurs. If the failure in engagement occurs, the plug is not extracted from the mandrel and the plug is not screwed into the mandrel. As a result, the plug is not easily exchanged.

Patent Document 1 below discloses an exchanging method of a plug for preventing the above-described failure in engagement.

In Patent Document 1 below, whenever the plug is rotated once, the plug is moved back and forth, and a rotating angle and a position of the plug suitable for avoiding the failure in engagement are detected. Moreover, the plug is further rotated using the detected value.

PRIOR ART DOCUMENT

Patent Document

[Patent Document 1] Japanese Unexamined Patent Application, First Publication No. 2008-229648

DISCLOSURE OF THE INVENTION

Problems to be Solved by the Invention

In the exchanging method of the plug disclosed in Patent Document 1, in order to avoid the failure in engagement, the rotating angle and the position of the plug should be detected, and exchange work is complicated or exchange time is lengthened. That is, in the related art, the exchange of the plug with respect to the mandrel is difficult, and maintenance becomes difficult. When production efficiency or maintenance during the piercing-rolling is considered, it is preferable that the exchange of the plug with respect to the mandrel be easily performed.

The present invention is made in consideration of the above-described circumstances, and an object thereof is to allow easy exchanging of the plug with respect to the mandrel and to make maintenance easier.

Means for Solving the Problem

The present invention adopts the following means to solve the problems and to achieve the related object.

(1) According to an aspect of the present invention, there is provided an inner surface regulation tool including: a mandrel; a plug which is detachably connected to the mandrel; and a connection member which connects the plug and the mandrel by a magnetic force, in which one of the plug and the mandrel includes a column-shaped portion which extends in an axial direction of the one, the other of the plug and the mandrel includes a joining hole which extends in an axial direction of the other and into which the column-shaped portion is inserted, and the connection member is a permanent magnet which is attached to at least one of the column-shaped portion and the joining hole.

According to this configuration, since the plug and the mandrel are connected to each other by the magnetic force, attachment and detachment (exchange) of the plug with respect to the mandrel are easily performed, and as a result, maintenance is performed more easily.

(2) In the inner surface regulation tool according to (1), cross-sectional shapes of the column-shaped portion and the joining hole may be circles.

According to this configuration, the plug can freely rotate around the axial direction. As a result, for example, even when the plug receives an external force in a circumferential direction such as torsion from a round billet, a joint portion between the plug and the mandrel is not easily damaged.

(3) In the inner surface regulation tool according to (1) or (2), the connection member may be attached to at least one of an outer circumferential surface of the column-shaped portion and an inner circumferential surface of the joining hole.

According to this configuration, for example, since the connection member is disposed at a portion which does not easily obtain a high temperature from the round billet, the connection member can rigidly connect the plug and the mandrel.

(4) In the inner surface regulation tool according to (3), when the connection member is attached to the outer circumferential surface of the column-shaped portion, the joining hole may be formed in a ferromagnetic body which is at least a portion of the other of the plug and the mandrel, and when the connection member is attached to the inner circumferential surface of the joining hole, at least the column-shaped portion of one of the plug and the mandrel may be formed by a ferromagnetic body.

According to this configuration, the plug and the mandrel can be further rigidly connected to each other.

(5) In the inner surface regulation tool according to (4), when the connection member is attached to the outer circumferential surface of the column-shaped portion, one or more connection members may be disposed around an axis of one of the plug and the mandrel on the outer circumferential surface of the column-shaped portion, and when the connection member is attached to the inner circumferential surface of the joining hole, one or more connection members may be disposed around an axis of the other of the plug and the mandrel on the inner circumferential surface of the joining hole.

According to this configuration, the plug and the mandrel can be further rigidly connected to each other.

(6) In the inner surface regulation tool according to (4) or (5), when the connection member is attached to the outer circumferential surface of the column-shaped portion, the connection member may be attached to a position away from an end of the column-shaped portion, and when the connection member is attached to the inner circumferential surface of the joining hole, the connection member may be attached to a position away from an opening end of the joining hole.

For example, during hot pipe making (during piercing-rolling by a piercing machine or during drawing-rolling by an elongator) or the like, the plug easily receives an external force in the axial direction of the plug from the round billet. According to the configuration of (6), since the connection member does not easily come into contact with the bottom surface of the joining hole, the connection member is not easily damaged.

(7) In the inner surface regulation tool according to any one of (3) to (6), a groove may be formed on at least one of the outer circumferential surface of the column-shaped portion and the inner circumferential surface of the joining hole, and the connection member may be fitted to the groove so that a gap is generated between the surface of the connection member and the opening surface of the groove.

According to this configuration, since the connection member does not protrude from the groove to the outside, for example, during joining, heat pipe making, or the like, the connection member is not easily damaged.

(8) In the inner surface regulation tool according to (1) or (2), the connection member may be attached to at least one of an end surface of the column-shaped portion and a bottom surface of the joining hole.

According to this configuration, for example, since the connection member is disposed at a portion which does not easily obtain a high temperature from the round billet, the connection member can rigidly connect the plug and the mandrel.

(9) In the inner surface regulation tool according to (8), when the connection member is attached to the end surface of the column-shaped portion, the joining hole may be formed in a ferromagnetic body which is at least a portion of the other of the plug and the mandrel, and when the connection member is attached to the bottom surface of the joining hole, at least the column-shaped portion of one of the plug and the mandrel may be formed by a ferromagnetic body.

According to this configuration, the plug and the mandrel can be further rigidly connected to each other.

(10) In the inner surface regulation tool according to (9), a mounting hole may be formed on at least one of the end surface of the column-shaped portion and the bottom surface of the joining hole, and the connection member may be inserted into the mounting hole so that a gap is generated between the surface of the connection member and an opening surface of the mounting hole.

According to this configuration, since the connection member does not protrude from the mounting hole to the outside, for example, during joining, heat pipe making, or the like, the connection member is not easily damaged.

(11) According to another aspect of the present invention, there is provided a plug which is detachably connected to a mandrel, including: a column-shaped portion or a joining hole which extends in an axial direction of the plug; and a connection member which connects the mandrel and the plug by a magnetic force, in which the connection member is a permanent magnet which is attached to the column-shaped portion or the joining hole.

(12) In the plug according to (11), a cross-sectional shape of the column-shaped portion or the joining hole may be a circle.

(13) In the plug according to (11) or (12), the connection member may be attached to an outer circumferential surface of the column-shaped portion or an inner circumferential surface of the joining hole.

(14) In the plug according to (13), one or more connection members may be disposed around an axis of the plug on the outer circumferential surface of the column-shaped portion or the inner circumferential surface of the joining hole.

(15) In the plug according to (13) or (14), when the connection member is attached to the outer circumferential surface of the column-shaped portion, the connection member may be attached to a position away from an end of the column-shaped portion, and when the connection member is attached to the inner circumferential surface of the joining hole, the connection member may be attached to a position away from an opening end of the joining hole.

(16) In the plug according to any one of (13) to (15), a groove may be formed on the outer circumferential surface of the column-shaped portion or the inner circumferential surface of the joining hole, and the connection member may be fitted to the groove so that a gap is generated between the surface of the connection member and the opening surface of the groove.

(17) In the plug according to (11) or (12), the connection member may be attached to an end surface of the column-shaped portion or a bottom surface of the joining hole.

(18) In the plug according to (17), a mounting hole may be formed on the end surface of the column-shaped portion or the bottom surface of the joining hole, and the connection member may be inserted into the mounting hole so that a gap is generated between the surface of the connection member and an opening surface of the mounting hole.

(19) According to still another aspect of the present invention, there is provided a mandrel which is detachably connected to a plug, including: a column-shaped portion or a joining hole which extends in an axial direction of the mandrel; and a connection member which connects the mandrel and the plug by a magnetic force, in which the connection member is a permanent magnet which is attached to the column-shaped portion or the joining hole.

(20) In the mandrel according to (19), a cross-sectional shape of the column-shaped portion or the joining hole may be a circle.

(21) In the mandrel according to (19) or (20), the connection member may be attached to an outer circumferential surface of the column-shaped portion or an inner circumferential surface of the joining hole.

(22) In the mandrel according to (21), one or more connection members may be disposed around an axis of the mandrel on the outer circumferential surface of the column-shaped portion or the inner circumferential surface of the joining hole.

(23) In the mandrel according to (21) or (22), when the connection member is attached to the outer circumferential surface of the column-shaped portion, the connection member may be attached to a position away from an end of the column-shaped portion, and when the connection member is attached to the inner circumferential surface of the joining hole, the connection member may be attached to a position away from an opening end of the joining hole.

(24) In the mandrel according to any one of (21) to (23), a groove may be formed on the outer circumferential surface of the column-shaped portion or the inner circumferential surface of the joining hole, and the connection member may be fitted to the groove so that a gap is generated between the surface of the connection member and the opening surface of the groove.

(25) In the mandrel according to (19) or (20), the connection member may be attached to an end surface of the column-shaped portion or a bottom surface of the joining hole.

(26) In the mandrel according to (25), a mounting hole may be formed on the end surface of the column-shaped portion or the bottom surface of the joining hole, and the connection member may be inserted into the mounting hole so that a gap is generated between the surface of the connection member and an opening surface of the mounting hole.

(27) According to still another aspect of the present invention, there is provided a hot rolling mill for making a seamless metal pipe, including: a pair of inclined rolls; and an inner surface regulation tool according to any one of (1) to (10).

(28) According to still another aspect of the present invention, there is provided a press piercing machine for making a seamless metal pipe, including: a container; and an inner surface regulation tool according to any one of (1) to (10).

(29) According to still another aspect of the present invention, there is provided a drawing machine for making a seamless metal pipe, including: a tapered die; a chuck; and an inner surface regulation tool according to any one of (1) to (10).

Effects of the Invention

According to the aspects, exchange of a plug with respect to a mandrel is easily performed, and maintenance can be performed more easily.

EMBODIMENTS OF THE INVENTION

Figure 1:
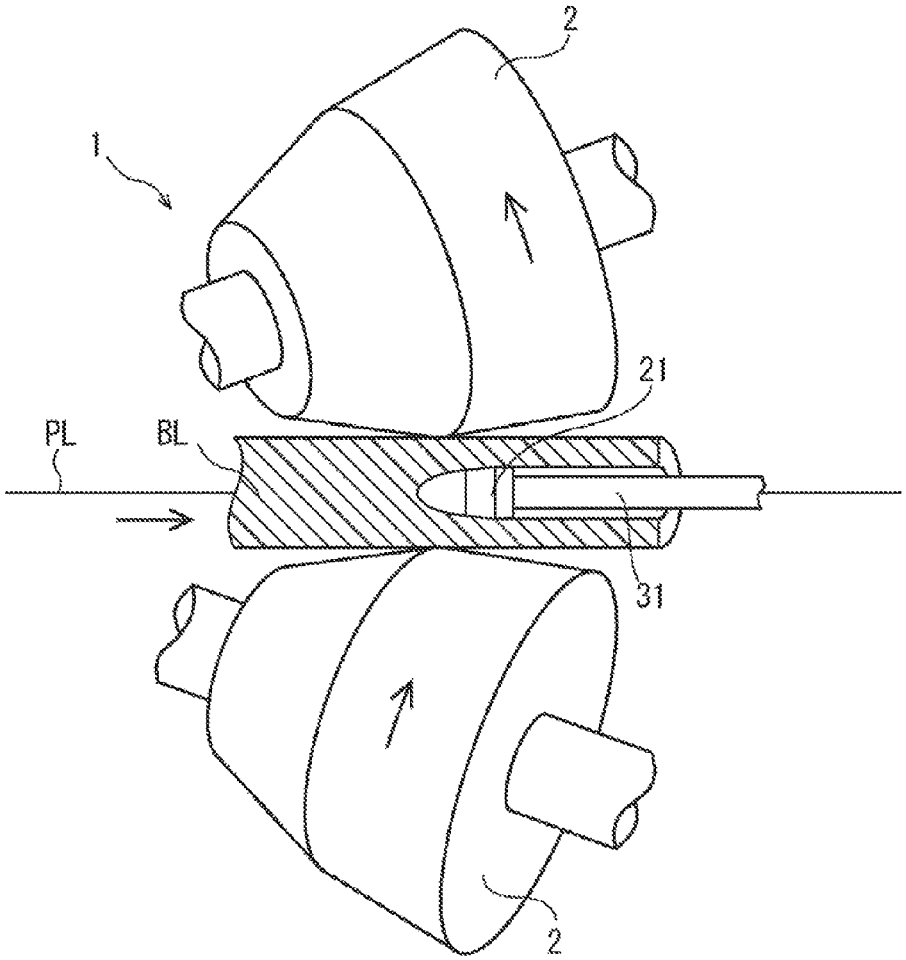
FIG. 1 is a schematic view showing a configuration of a piercing machine according to a first embodiment of the present invention.

Hereinafter, embodiments of the present invention will be described in detail with reference to the drawings. The same reference numerals are assigned to the same portions or the corresponding portions in the drawings, and descriptions thereof are omitted.

Hereinafter, a hot rolling mill for making a seamless metal pipe of the present embodiment will be described in detail. In descriptions below, as the hot rolling mill for making the seamless metal pipe, a piercing machine is described as the example. However, an elongator which is the same hot rolling mill also has the same configuration as the piercing machine.

First Embodiment

[Configuration of Hot Rolling Mill for Making Seamless Metal Pipe]

FIG. 1 is an overall configuration view of a piercing machine 1 which is a hot rolling mill for making a seamless metal pipe according to a first embodiment. As shown in FIG. 1, the piercing machine 1 includes a pair of inclined rolls 2 and an inner surface regulation tool 11. The inner surface regulation tool 11 includes a plug 21 and a mandrel 31. That is, in the inner surface regulation tool 11, the plug 21 and the mandrel 31 are integrally connected to each other, and an inner surface shape of a round billet BL described below is regulated by the inner surface regulation tool.

The pair of inclined rolls 2 is disposed around a pass line PL. The inclined rolls 2 roll the round billet BL while rotating the round billet in the circumferential direction. The inclined rolls 2 may be a cone type or a barrel type.

The plug 21 is disposed on the pass line PL between the pair of inclined rolls 2.

The mandrel 31 has a rod shape and is disposed on the pass line PL. The plug 21 is connected to a tip of the mandrel 31. The mandrel 31 supports the plug 21 on the pass line PL.

When the round billet BL is piercing-rolled by the piercing machine 1, the plug 21 is pushed into a center of the round billet BL, pierces the round billet BL, and forms a hollow pipe stock.

[Plug 21 and Mandrel 31]

Figure 2:
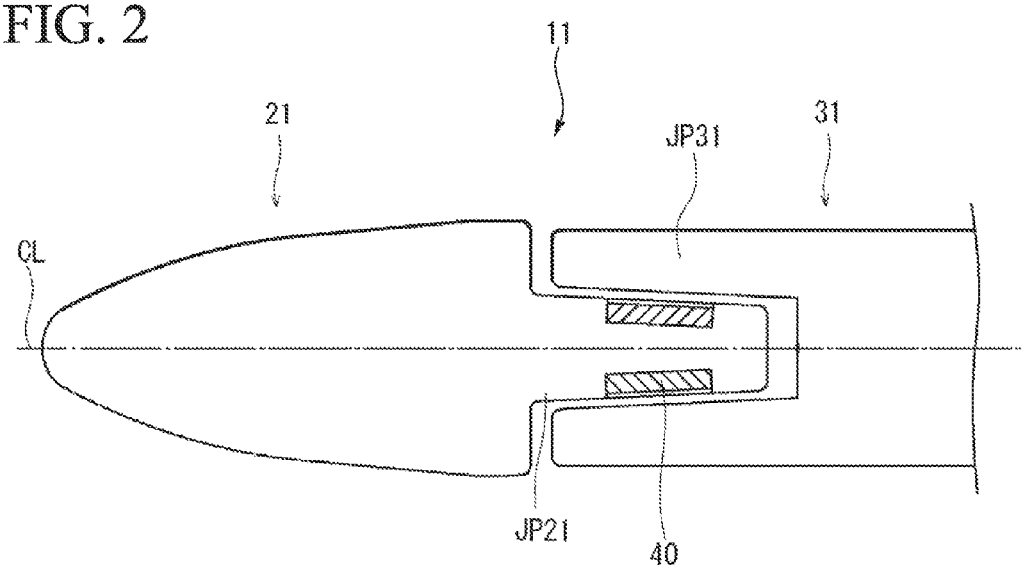
FIG. 2 is a longitudinal cross-sectional view of an inner surface regulation tool (plug and mandrel) in FIG. 1.

FIG. 2 is a longitudinal cross-sectional view of the inner surface regulation tool 11 (plug 21 and mandrel 31). Moreover, the longitudinal cross-sectional view means a cross-section including an axis CL of the plug 21 and the mandrel 31.

As shown in FIG. 2, a cross-sectional shape of an outer circumferential surface of the plug 21 is a circle, and an outer diameter of a tip of the plug 21 is smaller than that of the rear end. For example, as shown in FIG. 2, the plug 21 has a shell shape. However, the shape of the plug 21 is not limited to the shape of FIG. 2.

As shown in FIG. 2, the plug 21 includes a joint portion JP21 at the rear end, and the mandrel 31 includes a joint portion JP31 at the front end. In FIG. 2, the joint portion JP21 includes a connection member 40. The connection member 40 detachably connects the joint portion JP21 to the joint portion JP31 by a magnetic force. Accordingly, the plug 21 is supported by the mandrel 31.

[Joint Portion JP21 and Joint Portion JP31]

Figure 3:
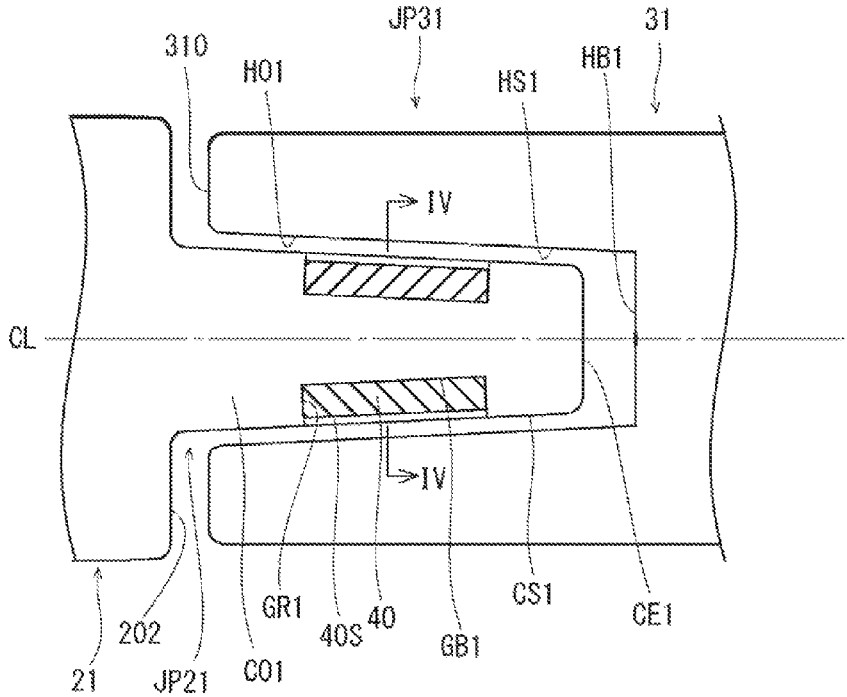
FIG. 3 is a longitudinal cross-sectional view of a joint portion of the inner surface regulation tool (plug and mandrel) in FIG. 2.

FIG. 3 is an enlarged view of the joint portions JP21 and JP31 in FIG. 2. As shown in FIG. 3, one of the joint portions JP21 and JP31 includes a column-shaped portion C01, and the other includes a joining hole H01. In FIG. 3, the joint portion JP21 includes the column-shaped portion C01, and the joint portion JP31 includes the joining hole H01. That is, in the first embodiment, the plug 21 includes the column-shaped portion C01, and the mandrel 31 includes the joining hole H01 into which the column-shaped portion C01 is inserted.

In addition, in FIG. 3, the joint portion JP21 and the joint portion JP31 are disposed with a gap therebetween. However, the joint portion JP21 and the joint portion JP31 may be connected to each other, the joint portion JP21 comes into contact with the joint portion JP31. In the drawings of the present specification, for convenience of the description, a gap is provided between the joint portions.

Figure 4:
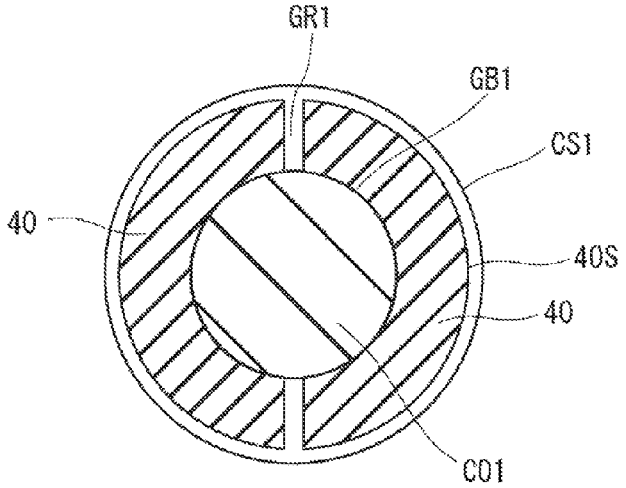
FIG. 4 is a cross-sectional view taken along line IV-IV in FIG. 3.

The column-shaped portion C01 extends in the direction of the axis CL from a rear end surface 202 of the plug 21. FIG. 4 is a cross-sectional view taken along line IV-IV in FIG. 3. As shown in FIG. 4, the cross-sectional shape of the column-shaped portion C01 is a circle. As shown in FIGS. 3 and 4, the column-shaped portion C01 includes an outer circumferential surface CS1 and an end surface CE1 as surfaces.

The joining hole H01 is formed on a front end surface 310 of the mandrel 31, and extends in the direction of the axis CL. The cross-sectional shape of the joining hole H01 is a circle, and the joining hole includes an inner circumferential surface HS1 and a bottom surface HB1 as surfaces.

The column-shaped portion C01 is inserted into the joining hole H01. When the column-shaped portion C01 is inserted into the joining hole H01, the outer circumferential surface CS1 opposes the inner circumferential surface HS1, and the end surface CE1 opposes the bottom surface HB1. In FIG. 3, the outer diameter of the column-shaped portion C01 gradually decreases toward the end surface CE1. That is, the column-shaped portion C01 has a tapered shape. Similarly, the inner diameter of the joining hole H01 gradually decreases toward the bottom surface HB1, and the shape of the joining hole H01 is a reverse tapered-shape. Accordingly, the column-shaped portion C01 is easily inserted into the joining hole H01.

The connection member 40 is attached to the outer circumferential surface CS1 of the column-shaped portion C01, and connects the column-shaped portion C01 to the joining hole H01 by a magnetic force. Accordingly, the plug 21 and the mandrel 31 are detachably connected to each other.

The connection member 40 is a magnet, and more specifically, is a permanent magnet. Meanwhile, a material of at least the joint portion JP31 in the mandrel 31 is a magnetic body, and more specifically, is a ferromagnetic body.

In this way, in the piercing machine 1, the plug 21 can be detachably connected to the mandrel 31 using the magnetic force of the connection member 40. In the related art, when the plug and the mandrel are connected to each other by a screw, as described above, a failure in engagement between threads of a male screw and a female screw may occur, and thus, exchange work of the plug may be complicated. In the first embodiment, the plug 21 and the mandrel 31 are connected to each other by the magnetic force of the connection member 40. As a result, the failure of engagement or the like of the joint portion does not occur, and attachment and detachment (exchange) of the plug 21 with respect to the mandrel 31 can be easily performed.

Since the joint portions JP21 and JP31 have simple structures (column-shaped portion C01 and joining hole H01), the joint portions JP21 and JP31 are not easily damaged during the piercing-rolling.

In the joint portions JP21 and JP31, since the plug 21 is connected to the mandrel 31 by the magnetic force (and, since the cross-sectional shapes of the column-shaped portion C01 and the joining hole H01 are circular shapes), the plug 21 can freely rotate around the axis CL during the piercing-rolling. As a result, for example, even when the plug 21 receives an external force in the circumferential direction such as torsion from the round billet BL, the joint portions JP21 and JP31 are not easily damaged.

The connection member 40 having the magnetic force is attached to the plug 21. Accordingly, a material of the plug 21 may not be a ferromagnetic body. A nonmagnetic highstrength heat-resistant material including Nb base alloy or Mo base alloy may be used as the material of the plug 21. However, the material of the plug 21 may be a ferromagnetic body.

The tip surface of the plug 21 and the outer layer portion in the vicinity thereof obtain a high temperature from the round billet B1, and the temperature becomes a high temperature of approximately 1000° C. during the piercing-rolling. However, in other regions except for the outer layer portion, the temperature is less than or equal to 300° C. even during the piercing-rolling. Particularly, the temperature of the periphery region of the joint portions JP21 and JP31 is less than 200° C. Accordingly, the connection member 40 has the magnetic force even during the piercing-rolling, and the plug 21 is connected to the mandrel 31 by the magnetic force.

As described above, the plug 21 may be exchanged at any time due to occurrence of erosion or the like. In the first embodiment, the attachment and detachment (exchange) of the plug 21 with respect to the mandrel 31 are easily performed. As a result, a reduction in rolling efficiency due to the exchange of the plug can be reduced, and the maintenance can be performed more easily.

As shown in FIGS. 3 and 4, a groove GR1 is formed on the outer circumferential surface CS1 of the column-shaped portion C01. The groove GR1 extends around the axis CL and includes a groove bottom surface GB1. In FIG. 4, a plurality of connection members 40 are attached to the groove GR1. Accordingly, the plurality of connection members 40 are disposed around the axis CL. As a result, an area which is adsorbed by the magnetic force is increased, and thus, the connection force is increased. The connection member 40 is fixed to the groove GR1 by a well-known method. For example, the connection member 40 may be fixed to the groove GR1 by shrinkage fitting, or may be fitted to the groove GR1 using a bonding agent. The connection member 40 may be fixed to the groove GR1 using a fixing member such as a screw or a bolt. In FIG. 4, two connection members 40 having an arc shape are disposed on the groove GR1. However, three or more connection members 40 having the arc shape may be disposed. Moreover, one or more connection members 40 may be disposed on the groove GR1.

As shown in FIG. 4, preferably, the connection member 40 is disposed inside the outer circumferential surface CS1 which is the surface of the column-shaped portion C01. More specifically, a surface 40S of the connection member 40 fitted to the groove GR1 is disposed to be closer to the groove bottom surface GB1 side than the outer circumferential surface CS1. In other words, preferably, the connection member 40 is fitted to the groove GR1 so that a gap is generated between the surface 40S of the connection member 40 and an opening surface (a surface which is flush with the outer circumferential surface CS1 of the column-shaped portion C01) of the groove GR1.

In this configuration, the connection member 40 does not protrude from the outer circumferential surface CS1 to the outside. Accordingly, when the plug 21 is attached to the mandrel 31, the connection member 40 does not easily come into contact with the inner circumferential surface HS1 of the joining hole H01. As a result, during the joining or during piercing-rolling, cracks or damage of the connection member 40 can be prevented.

As shown in FIG. 3, preferably, the connection member 40 is attached at a position away from the rear end (rear end surface CE1) of the column-shaped portion C01I. According to this configuration, during the joining, the connection member 40 does not come into contact with the bottom surface HB1 of the joining hole H01, and instead, the rear end surface CE1 comes into contact with the bottom surface HB1.

During the piercing-rolling, the plug 21 is pushed into the round billet BL. At this time, the plug 21 receives a strong external force in the direction of the axis CL. The plug 21 is pressed to the mandrel 31 by the external force.

If the connection member 40 is attached to the rear end of the outer circumferential surface CS1 (the rear end of the column-shaped portion C01) and the connection member 40 comes into contact with the bottom surface HB1 during the joining, the connection member 40 is pressed to the bottom surface HB1 by the external force and is easily damaged.

As shown in FIG. 3, if the connection member 40 is attached at a position away from the rear end of the outer circumferential surface CS1, the external force applied in the direction of the axis CL during the piercing-rolling is applied to the rear end surface CE1 and is not easily applied to the connection member 40. As a result, the connection member 40 is not easily damaged.

Second Embodiment

In the first embodiment, the connection member 40 is attached to the column-shaped portion C01. However, the connection member 40 may be attached to the joining hole H0.

Figure 5:
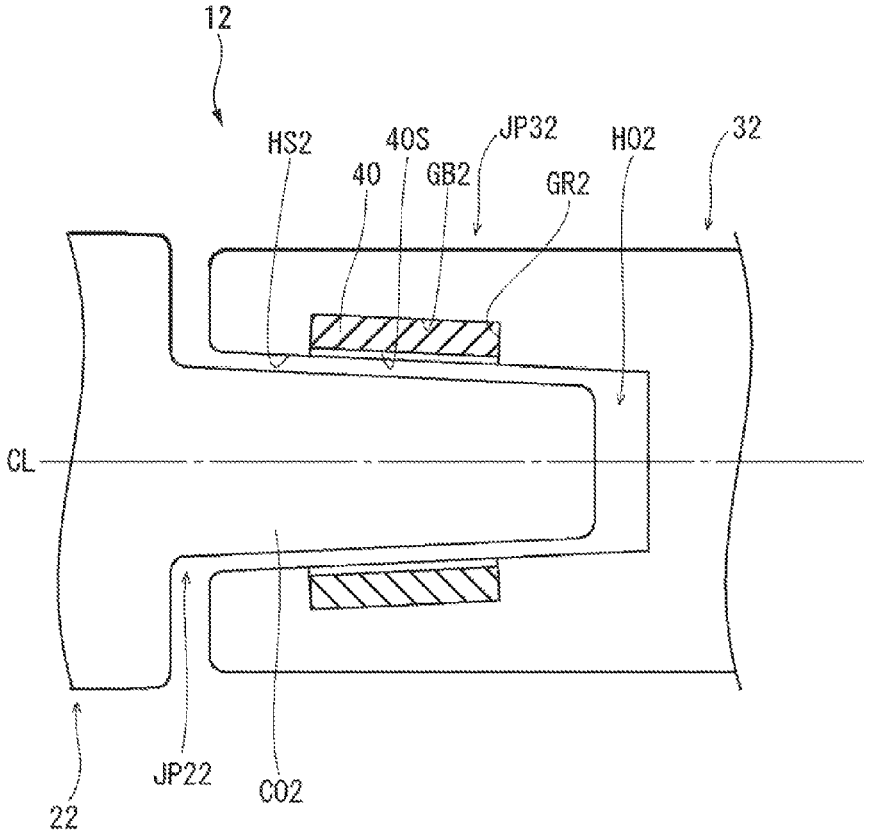
FIG. 5 is a longitudinal cross-sectional view of a joint portion of an inner surface regulation tool (plug and mandrel) of a piercing machine according to a second embodiment of the present invention.

FIG. 5 is a longitudinal cross-sectional view of a joint portion (a joint portion between a plug 22 and a mandrel 32) of an inner surface regulation tool 12 in a piercing machine of a second embodiment. Other configurations of the piercing machine of the second embodiment are the same as the piercing machine 1 of the first embodiment.

As shown in FIG. 5, the plug 22 includes a joint portion JP22 on the rear end, and other configurations are the same as the plug 21. The joint portion JP22 includes a column-shaped portion C02. Compared to the column-shaped portion C01, in the column-shaped portion C02, a groove is not formed on an outer circumferential surface CS2, and the connection member 40 is not attached to the groove. Other configurations of the column-shaped portion C02 are the same as the column-shaped portion C01.

The mandrel 32 includes a joint portion JP32 on the front end. Other configurations are the same as the mandrel 31. The joint portion JP32 includes a joining hole H02. Compared to the joining hole H01, in the joining hole H02, a groove GR2 is formed on an inner circumferential surface HS2, and the connection member 40 is fitted to the groove GR2. Other configurations of the joining hole H02 are the same as the joining hole H01.

That is, in the second embodiment, instead of the outer circumferential surface CS2 of the column-shaped portion C02, a plurality of (the number may be one or more) connection members 40 are attached to the inner circumferential surface HS2 of the joining hole H02. Accordingly, the material of the joining portion JP 22 (column-shaped portion C02) is a ferromagnetic body.

Similar to the first embodiment, the joint portions JP22 and JP32 having the above-described configuration also can connect the plug 22 to the mandrel 32 by the magnetic force.

The groove GR2 extends around the axis CL. Accordingly, a plurality of connection members 40 are disposed around the axis CL. As a result, the area which is adsorbed by the magnetic force is increased, and thus, the connection force is increased. Similar to the first embodiment, in the second embodiment, preferably, the connection member 40 is disposed inside the inner circumferential surface HS2. That is, the surface 40S of the connection member is disposed to be closer to the groove bottom surface GB2 side than the inner circumferential surface HS2. In other words, preferably, the connection member 40 is fitted to the groove GR2 so that a gap is generated between the surface 40S of the connection member 40 and an opening surface (a surface which is flush with the inner circumferential surface HS2 of the joining hole H02) of the groove GR2.

Third Embodiment

Figure 6:
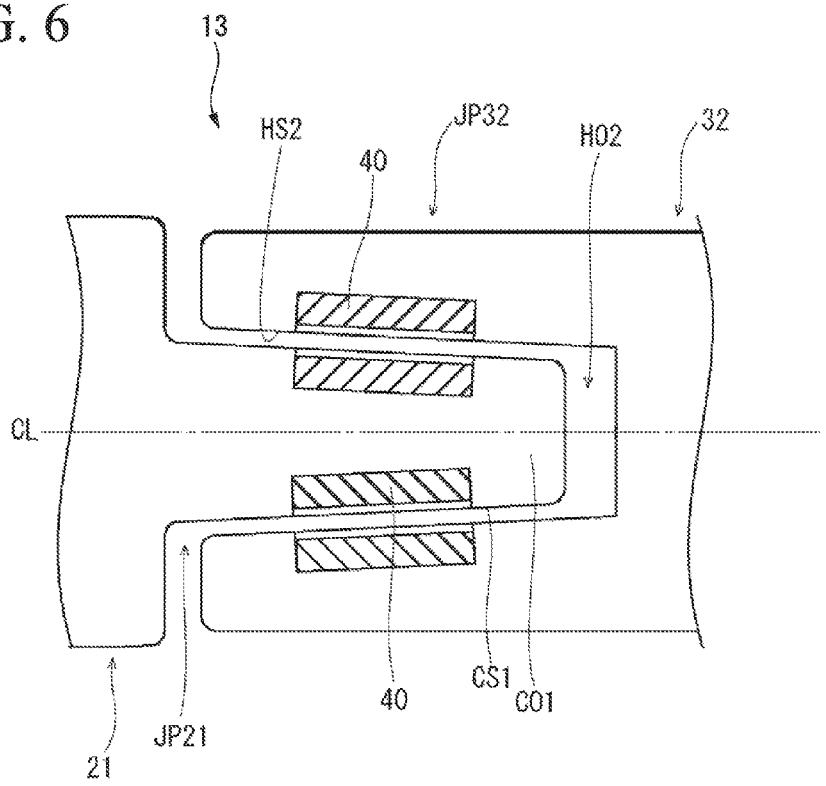
FIG. 6 is a longitudinal cross-sectional view of a joint portion of an inner surface regulation tool (plug and mandrel) of a piercing machine according to a third embodiment of the present invention.

FIG. 6 is a longitudinal cross-sectional view of a joint portion (the joint portion between the plug 21 and the mandrel 32) of an inner surface regulation tool 13 in a piercing machine of a third embodiment. As shown in FIG. 6, the inner surface regulation tool 13 of the third embodiment includes the plug 21 and the mandrel 32. In this case, the joint portion between the plug 21 and the mandrel 32 is configured of the joint portion JP21 and the joint portion JP32. That is, in the third embodiment, the connection members 40 are attached to both the outer circumferential surface CS1 of the column-shaped portion C01 and the inner circumferential surface HS2 of the joining hole H02.

The connection member 40 of the outer circumferential surface CS1 and the connection member 40 of the inner circumferential surface HS2 are disposed to oppose each other, and thus, are disposed to be attracted to each other. Accordingly, the plug 21 is connected to the mandrel 32 by the magnetic force. In the third embodiment, as the materials of the joint portion JP21 and the joint portion JP32, a nonmagnetic material may be used.

Fourth Embodiment

In the first to third embodiments, the plugs 21 and 22 include the column-shaped portions C01 and C02, and the mandrels 31 and 32 include the joining holes H01 and H02. However, even when the mandrel includes a column-shaped portion C0 and the plug includes a joining hole H0, effects similar to the first to third embodiments can be obtained.

Figure 7:
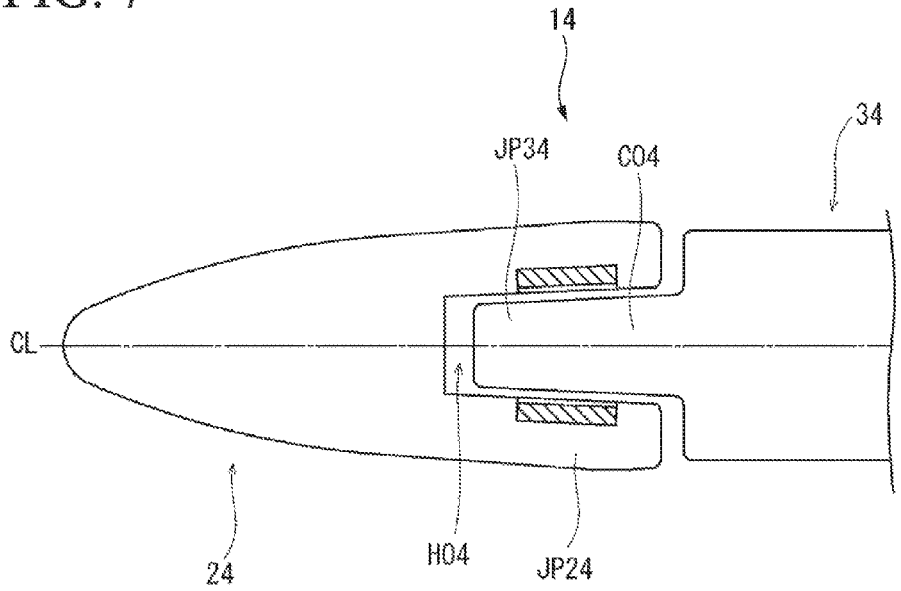
FIG. 7 is a longitudinal cross-sectional view of an inner surface regulation tool (plug and mandrel) of a piercing machine according to a fourth embodiment of the present invention.

FIG. 7 is a longitudinal cross-sectional view of an inner surface regulation tool 14 (a plug 24 and a mandrel 34) in a piercing machine of a fourth embodiment. As shown in FIG. 7, a joint portion JP24 of the plug 24 includes a joining hole H04. On the other hand, a joint portion JP34 of the mandrel 34 includes a column-shaped portion C04.

Figure 8:
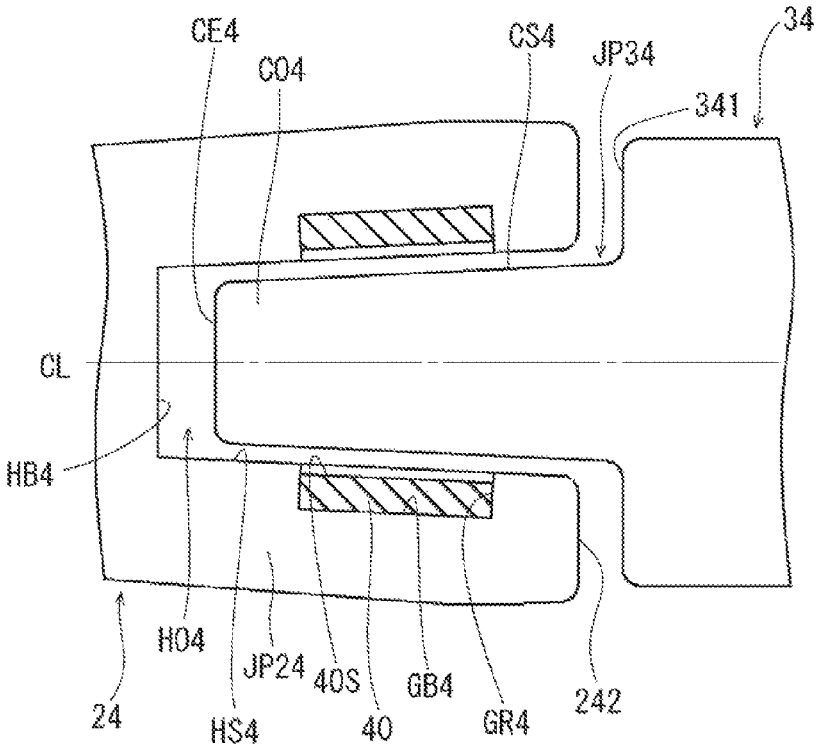
FIG. 8 is a longitudinal cross-sectional view of a joint portion of the inner surface regulation tool (plug and mandrel) in FIG. 7.

FIG. 8 is an enlarged view of the joint portions JP24 and JP34 in FIG. 7. As shown in FIG. 8, the joining hole H04 extends in the direction of the axis CL from a rear end surface 242 of the plug 24, and includes an inner circumferential surface HS4 and a bottom surface HB4 as surfaces. The column-shaped portion C04 extends in the direction of the axis CL from a front surface 341 of the mandrel 34, and includes an outer circumferential surface CS4 and a front end surface CE4 as surfaces. During the joining, the column-shaped portion C04 is inserted into the joining hole H04. Preferably, the front end surface CE4 comes into contact with the bottom surface HB4. A groove GR4 extending around the axis CL is formed on the inner circumferential surface HS4. A plurality of (the number may be 1) connection members 40 are fitted to the groove GR4.

In this way, also in the case where the joint portion JP24 (that is, the plug 24) includes the joining hole H04 and the joint portion JP34 (that is, the mandrel 34) includes the column-shaped portion C04, similar to other embodiments, the plug 24 can be connected to the mandrel 34 by the magnetic force of the connection member 40. In the fourth embodiment, the material of the mandrel 34 in which the connection member 40 is not provided is a ferromagnetic body.

Preferably, the connection member 40 is disposed inside the inner circumferential surface HS4. That is, the surface 40S of the connection member 40 is disposed to be closer to the groove bottom surface GB4 side of the groove GR4 than the inner circumferential surface HS4. In other words, preferably, the connection member 40 is fitted to the groove GR4 so that a gap is generated between the surface 40S of the connection member 40 and an opening surface (a surface which is flush with the inner circumferential surface HS4 of the joining hole H04) of the groove GR4.

Fifth Embodiment

Figure 9:
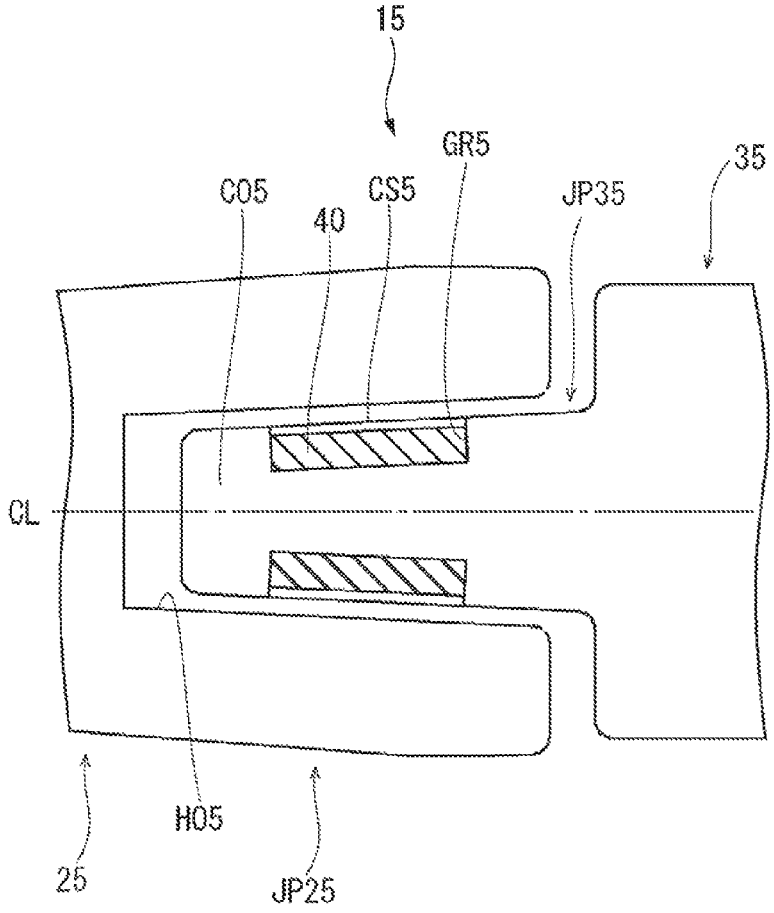
FIG. 9 is a longitudinal cross-sectional view of an inner surface regulation tool (plug and mandrel) of a piercing machine according to a fifth embodiment of the present invention.

FIG. 9 is a longitudinal cross-sectional view of a joint portion (a joint portion between a plug 25 and a mandrel 35) of an inner surface regulation tool 15 in a piercing machine of a fifth embodiment.

As shown in FIG. 9, a joint portion JP25 of the plug 25 includes a joining hole H05. A joint portion JP35 of the mandrel 35 includes a column-shaped portion C05.

Compared to the fourth embodiment, in the fifth embodiment, the connection member 40 is not attached to the joining hole H05 but to the column-shaped portion C05. A groove GR5 extending around the axis CL is formed on an outer circumferential surface CS5 of the column-shaped portion C05, and the connection member 40 is fitted to the groove GR5. In the fifth embodiment, the material of the plug 25 is a ferromagnetic body.

Sixth Embodiment

Figure 10:
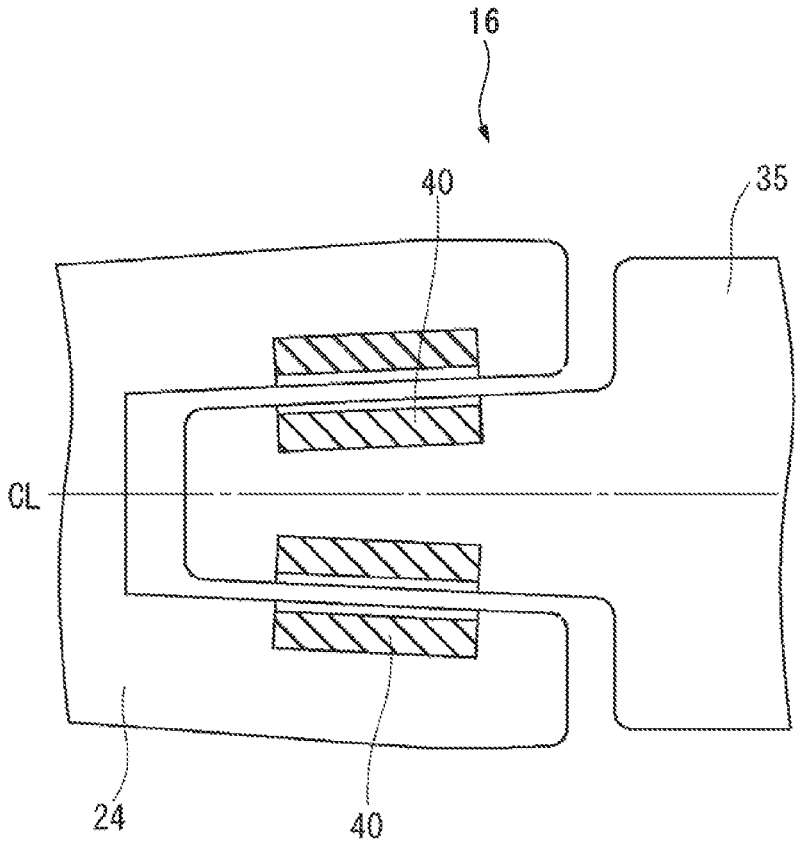
FIG. 10 is a longitudinal cross-sectional view of an inner surface regulation tool (plug and mandrel) of a piercing machine according to a sixth embodiment of the present invention.

As shown in FIG. 10, an inner surface regulation tool 16 of a piercing machine according to a sixth embodiment may include the plug 24 and the mandrel 35. In this case, the connection member 40 attached to the plug 24 and the connection member 40 attached to the mandrel 35 are disposed to oppose each other during the joining, and thus, are disposed to be attracted to each other.

As described in the first to sixth embodiments, one of the joint portion of the plug and the joint portion of the mandrel includes the column-shaped portion C0, and the other includes joining hole H0. Moreover, the connection member 40 may be attached to at least one of the column-shaped portion C0 and the joining hole H0. Moreover, when the connection member 40 is attached to any one of the column-shaped portion C0 and the joining hole H0, the material of the joint portion different from the joint portion to which the connection member 40 is attached may be a ferromagnetic body. The plug and the mandrel including the connection portion are easily connected to each other detachably.

Seventh Embodiment

In the first to sixth embodiments, the connection member 40 is attached to at least one of the outer circumferential surface CS of the column-shaped portion C0 and the inner circumferential surface HS of the joining hole H0. However, the connection member 40 may be attached to other portions.

Figure 11:
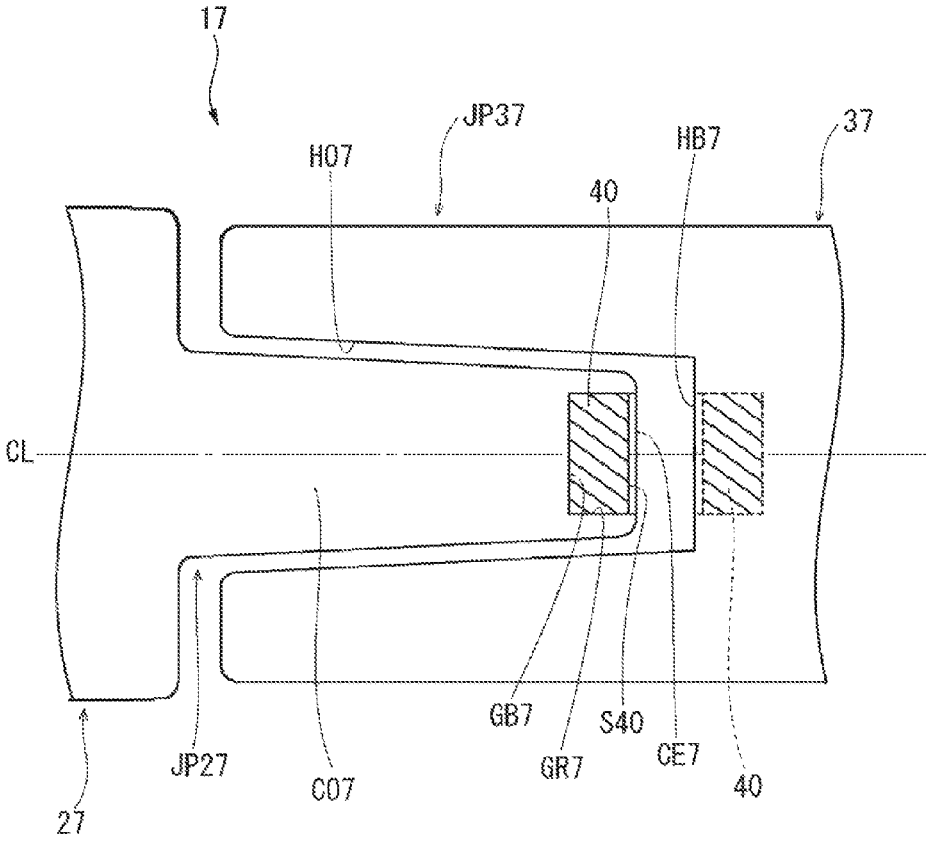
FIG. 11 is a longitudinal cross-sectional view of an inner surface regulation tool (plug and mandrel) of a piercing machine according to a seventh embodiment of the present invention.

FIG. 11 is a longitudinal cross-sectional view of a joint portion (a joint portion between a plug 27 and a mandrel 37) of an inner surface regulation tool 17 of a piercing machine according to a seventh embodiment. As shown in FIG. 11, a joint portion JP27 of the plug 27 includes a column-shaped portion C07. A joint portion JP37 of the mandrel 37 includes a joining hole H07.

The column-shaped portion C07 is inserted into the joining hole H07. At the time, a rear end surface CE7 of the column-shaped portion C07 opposes a bottom surface HB7 of the joining hole H07. Preferably, the rear end surface CE7 comes into contact with the bottom surface HB7.

The connection member 40 is attached to the rear end surface CE7 of the column-shaped portion C07. In this case, for example, the connection member 40 is formed in a plate shape. A plurality of (the number may be one) connection members 40 may be attached to the joining hole H07. A mounting hole GR7 including a bottom surface GB7 is formed on the rear end surface CE7. The connection member 40 is disposed in the mounting hole GR7, and is attached by shrinkage fitting, a bonding agent, or the like.

That is, in the seventh embodiment, the connection member 40 is attached to the rear end surface CE7 of the column-shaped portion C07. In this case, the material of the joint portion JP37 of the mandrel 37 is a ferromagnetic body. Also in the case, the plug 27 can be connected to the mandrel 37 by the magnetic force of the connection member 40.

Preferably, the connection member 40 is disposed inside the rear end surface CE7. More specifically, the surface 40S (the surface which opposes the bottom surface HB7) of the connection member 40 is disposed to be closer to the bottom surface GB7 side of the mounting hole GR7 than the rear end surface CE7. In other words, preferably, the connection member 40 is fitted to the mounting hole GR7 so that a gap is generated between the surface 40S of the connection member 40 and an opening surface (a surface which is flush with the rear end surface CE7 of the column-shaped portion C07) of the mounting hole GR7.

As described above, the plug 27 receives a strong external force in the direction of the axis CL during the piercing-rolling. Accordingly, the rear end surface CE7 is strongly pressed while coming into contact with the bottom surface HB7. If the connection member 40 protrudes from the rear end surface CE7 to the outside, the connection member 40 comes into contact with the bottom surface HB7. Accordingly, the connection member 40 may be damaged during the piercing-rolling. If the surface 40S of the connection member 40 is disposed inside the rear end surface CE7, the damage of the connection member 40 can be prevented.

As shown by a dotted line in FIG. 11, the connection member 40 is not attached to the rear end surface CE7 but may be attached to a bottom surface HB7 of the joining hole H07. In this case, a mounting hole for inserting the connection member 40 is formed in the bottom surface HB7. In this case, the material of the joint portion JP27 (column-shaped portion C07) of the plug 27 is a ferromagnetic body.

Moreover, the connection members 40 may be attached to both the rear end surface CE7 of the column-shaped portion C07 and the bottom surface HB7 of the joining hole H07. In this case, preferably, the connection member 40 of the rear end surface CE7 and the connection member 40 of the bottom surface HB7 are disposed to oppose each other, and are disposed to be attracted to each other.

Eighth Embodiment

Figure 12:
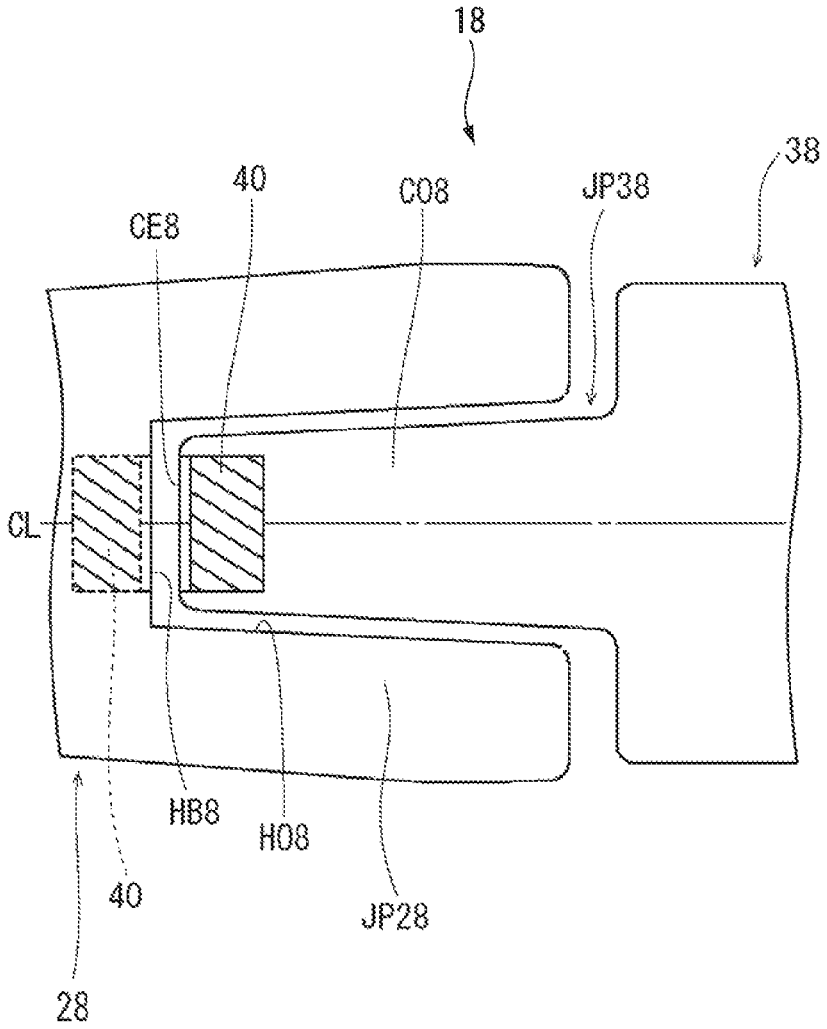
FIG. 12 is a longitudinal cross-sectional view of an inner surface regulation tool (plug and mandrel) of a piercing machine according to an eighth embodiment of the present invention.

As shown in FIG. 12, an inner surface regulation tool 18 of a piercing machine according to an eighth embodiment includes a plug 28 and a mandrel 38. A joint portion JP28 of the plug 28 includes a joining hole H08 instead of the column-shaped portion C0, and a joint portion JP38 of the mandrel 38 includes a column-shaped portion C08 instead of the joining hole H0. In addition, the connection member 40 is attached to at least one of a front end surface CE8 of the column-shaped portion C08 and a bottom surface HB8 of the joining hole H08. Moreover, at least the material of the joint portion different from the joint portion to which the connection member 40 is attached is a ferromagnetic body. Similar to the seventh embodiment, also in this case, the plug 28 is connected to the mandrel 38 by the magnetic force.

That is, one of the joint portion of the plug and the joint portion of the mandrel may include the column-shaped portion C0, the other may include the joining hole H0, and the connection member 40 may be attached to at least one of the end surface CE of the column-shaped portion C0 and the bottom surface HB of the joining hole H0. Moreover, at least the material of the joint portion different from the joint portion to which the connection member 40 is attached may be a ferromagnetic body.

In the first to eighth embodiments, the cross-sectional shape of the column-shaped portion C0 is a circle. However, the cross-sectional shape of the column-shaped portion C0 may not be a circle but, for example, may be a polygon or an ellipse. In this case, even though the head member may not be freely rotated, similar to the first to eighth embodiments, the plug is detachably connected to the mandrel.

Moreover, the column-shaped portion C0 and the joining hole H0 may not be a tapered shape. For example, the column-shaped portion C0 may be a circular columnar shape.

In the first to eighth embodiments, the joint portion includes the plurality of connection members 40. However, the joint portion may include only one connection member 40.

In the first to eighth embodiments, the piercing machine is exemplified as the hot rolling mill for making a seamless metal pipe. The hot rolling mill for making a seamless metal pipe is not limited to the piercing machine, and also includes an elongator which has the same configuration as the piercing machine. Accordingly, if the elongator which is the hot rolling mill for making a seamless metal pipe includes the above-described inner surface regulation tool (plug and mandrel), the above-described effects can be obtained.

In addition, the inner surface regulation tool (plug and mandrel) of the present invention is not limited to the hot rolling mill, and for example, may be applied to a press piercing machine, a drawing machine, or the like. The press piercing machine includes a configuration for making a seamless steel pipe based on the Ugine pipe making process which is one of the processes for making a seamless steel pipe.

Figure 13:
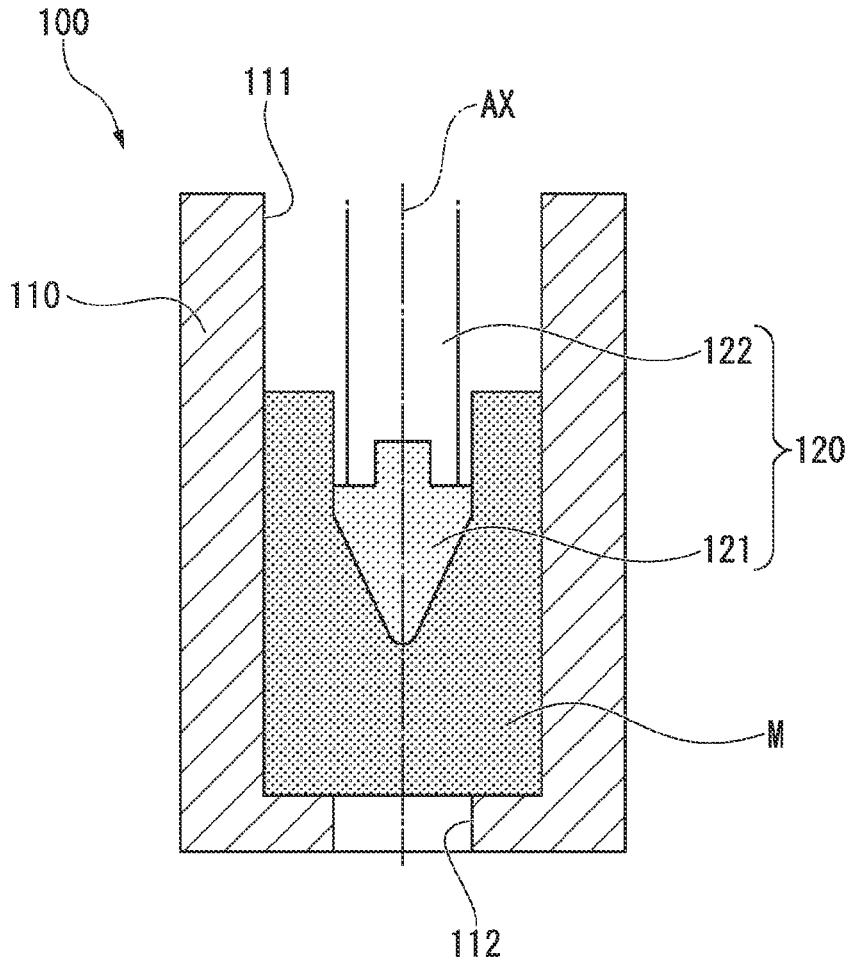
FIG. 13 is a view showing a configuration example of a press piercing machine according to the present embodiment.

FIG. 13 shows a configuration example of the press piercing machine. As shown in FIG. 13, a press piercing machine 100 includes a hollow cylindrical container 110 and an inner surface regulation tool 120 which is disposed in an inner space of the container 110.

A first opening portion 111 is provided on one end of the container 110, and a second opening portion 112 having a smaller diameter than the first opening portion 111 is provided on the other end of the container 110. The second opening portion 112 is provided so that the center of the second opening portion is coincident with a center axis AX of the container 110.

The inner surface regulation tool 120 includes a plug 121 and a mandrel 122. The configuration of the inner surface regulation tool 120, that is, the configurations of the plug 121 and the mandrel 122 may adopt any configuration of the first to eighth embodiments.

The inner surface regulation tool 120 is disposed in the inner space of the container 110 so that the axis of the inner surface regulation tool (axes of the plug 121 and the mandrel 122) is coincident with the center axis AX of the container 110. Moreover, the inner surface regulation tool 120 is disposed so that the plug 121 is directed to the second opening portion 112 of the container 110. In addition, the inner surface regulation tool 120 can move along the center axis AX of the container 110. Moreover, a diameter of the second opening portion 112 of the container 110 is larger than a diameter of the plug 121.

In the press piercing machine 100 configured as described above, a workpiece M is accommodated in the inner space of the container 110 from the first opening portion 111 of the container 110. In the state where the workpiece M is accommodated in the container 110, the inner surface regulation tool 120 moves from the first opening portion 111 side toward the second opening portion 112 side along the center axis AX of the container 110, and passes through (penetrates) the second opening portion 112.

As a result, the workpiece M is extruded from the second opening portion 112 and a steel pipe is formed. This steel pipe (that is, the workpiece M extruded from the second opening portion 112) has an inner diameter which is the same as the diameter of the plug 121 and an outer diameter which is the same as the diameter of the second opening portion 112.

Figure 14:
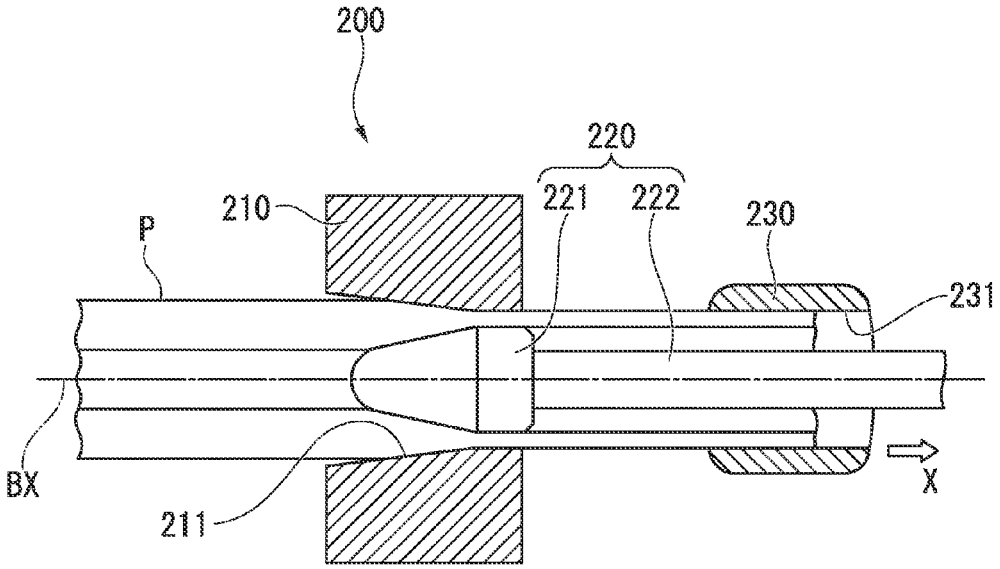
FIG. 14 is a view showing a configuration example of a drawing machine according to the present embodiment.

Meanwhile, FIG. 14 shows a configuration example of a drawing machine. As shown in FIG. 14, a drawing machine 200 includes a tapered die 210, an inner surface regulation tool 220, and a chuck 230. The tapered die 210 includes a first through-hole 211 having a circular cross-section. The first through-hole 211 has a diameter which gradually decreases from one side (the left side in FIG. 14) of the tapered die 210 to the other side (the right side in FIG. 14). That is, as shown in FIG. 14, when viewed from a direction orthogonal to a center axis BX of the first through-hole 211, the inner circumferential surface of the first through-hole 211 has a tapered shape.

The inner surface regulation tool 220 includes a plug 221 and a mandrel 222. The configuration of the inner surface regulation tool 220, that is, the configurations of the plug 221 and the mandrel 222 may adopt any configuration of the first to eighth embodiments.

The inner surface regulation tool 220 is disposed so that the axis of the inner surface regulation tool (axes of the plug 221 and the mandrel 222) is coincident with the center axis BX of the first through-hole 211. Moreover, the inner surface regulation tool 220 is disposed so that the plug 221 is accommodated from the minimum diameter side of the first through-hole 211 into the first through-hole 211. In addition, the minimum diameter of the first through-hole 211 is larger than the diameter of the plug 221.

The chuck 230 includes a second through-hole 231 in which the cross-section is circular and the diameter is constant. The chuck 230 is disposed so that the center axis of the second through-hole 231 is coincident with the center axis BX of the first through-hole 211. Moreover, the chuck 230 can move along the center axis BX of the first through-hole 211. In addition, the diameter of the second through-hole 231 of the chuck 230 is the same as the minimum diameter of the first through-hole 211 of the tapered die 210.

In the drawing machine 200 configured as described above, in the state where the inner surface regulation tool 220 is disposed, a pipe P which is a workpiece is inserted from the maximum diameter side of the first through-hole 211 of the tapered die 210 toward the minimum diameter side. The tip of the pipe P drawn from the minimum diameter side of the first through-hole 211 of the tapered die 210 is chucked (fixed) by the chuck 230. In a state where the tip of the pipe P is fixed by the chuck 230, the chuck 230 moves in an X direction in FIG. 14.

As a result, the thickness of the pipe P is thinned, and a desired steel pipe is formed. This steel pipe (that is, the pipe P drawn from the tapered die 210) has an inner diameter which is the same as the diameter of the plug 221, and an outer diameter which is the same as the minimum diameter of the first through-hole 211.

The embodiments of the present invention are described above. However, the above-described embodiments are only examples for exemplifying the present invention. Accordingly, the present invention is not limited to the above-described embodiments only, and the above-described embodiments can be appropriately modified within the scope of the invention.

BRIEF DESCRIPTION OF THE REFERENCES SYMBOLS

1: PIERCING MACHINE
100: PRESS PIERCING MACHINE
200: DRAWING MACHINE
11 to 18, 120, and 220: INNER SURFACE REGULATION TOOL
21, 22, 24, 25, 27, 28, 121, and 221: PLUG
31, 32, 34, 35, 37, 38, 122, and 222: MANDREL
40: CONNECTION MEMBER
C01, C02, C04, C05, C07, and C08: COLUMN-SHAPED PORTION
H01, H02, H04, H05, H07, and H08: JOINING HOLE

The invention claimed is:

1. An inner surface regulation tool, comprising:
a mandrel;
a plug which is detachably connected to the mandrel; and
a connection member which connects the plug and the mandrel by a magnetic force,
wherein one of the plug and the mandrel includes a column-shaped portion which extends in an axial direction of the one, and the other of the plug and the mandrel includes a joining hole which extends in an axial direction of the other and into which the column-shaped portion is inserted, and
wherein the connection member is a permanent magnet which is attached to at least one of the column-shaped portion and the joining hole, and
wherein the connection member is fitted to a groove which is formed on at least one of an outer circumferential surface of the column-shaped portion or an inner circumferential surface of the joining hole so that a gap is generated between a surface of the connection member and an opening surface of the groove, or the connection member is fitted to a mounting hole which is formed on at least one of a rear end surface of the column-shaped portion or a bottom surface of the joining hole so that a gap is generated between a surface of the connection member and an opening surface of the mounting hole.

2. The inner surface regulation tool according to claim 1, wherein cross-sectional shapes of the column-shaped portion and the joining hole are circles.

3. The inner surface regulation tool according to claim 1 or 2, wherein when the connection member is attached to the outer circumferential surface of the column-shaped portion, the joining hole is formed in a ferromagnetic body which is at least a portion of the other of the plug and the mandrel, and wherein when the connection member is attached to the inner circumferential surface of the joining hole, at least the column-shaped portion of one of the plug and the mandrel is formed by a ferromagnetic body.

4. A hot rolling mill for making a seamless metal pipe, comprising:

a pair of inclined rolls; and an inner surface regulation tool according to claim 1 or 2.

5. A press piercing machine for making a seamless metal pipe, comprising:

a container; and an inner surface regulation tool according to claim 1 or 2.

6. A drawing machine for making a seamless metal pipe, comprising:

a tapered die;

a chuck; and an inner surface regulation tool according to claim 1 or 2.

7. A plug which is detachably connected to a mandrel, comprising:

a column-shaped portion or a joining hole which extends in an axial direction of the plug; and a connection member which connects the mandrel and the plug by a magnetic force, wherein the connection member is a permanent magnet which is attached to the column-shaped portion or the joining hole, and wherein the connection member is fitted to a groove which is formed on at least one of an outer circumferential surface of the column-shaped portion or an inner circumferential surface of the joining hole so that a gap is generated between a surface of the connection member and an opening surface of the groove, or the connection member is fitted to a mounting hole which is formed on at least one of a rear end surface of the column-shaped portion or a bottom surface of the joining hole so that a gap is generated between a surface of the connection member and an opening surface of the mounting hole.

8. The plug according to claim 7, wherein a cross-sectional shape of the column-shaped portion or the joining hole is a circle.

9. A mandrel which is detachably connected to a plug, comprising:

a column-shaped portion or a joining hole which extends in an axial direction of the mandrel; and a connection member which connects the mandrel and the plug by a magnetic force, wherein the connection member is a permanent magnet which is attached to the column-shaped portion or the joining hole, and wherein the connection member is fitted to a groove which is formed on at least one of an outer circumferential surface of the column-shaped portion or an inner circumferential surface of the joining hole so that a gap is generated between a surface of the connection member and an opening surface of the groove, or the connection member is fitted to a mounting hole which is formed on at least one of a rear end surface of the column-shaped portion or a bottom surface of the joining hole so that a gap is generated between a surface of the connection member and an opening surface of the mounting hole.

* * * * *